US007864020B2

(12) United States Patent
Chen et al.

(10) Patent No.: US 7,864,020 B2
(45) Date of Patent: Jan. 4, 2011

(54) COMPOSITE TRANSFORMER

(75) Inventors: Yi-Lin Chen, Taoyuan Hsien (TW); Bou-Jun Zung, Taoyuan Hsien (TW); Shih-Hsien Chang, Taoyuan Hsien (TW); Hsin-Wei Tsai, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/500,883

(22) Filed: Jul. 10, 2009

(65) Prior Publication Data

US 2010/0214053 A1 Aug. 26, 2010

(30) Foreign Application Priority Data

Feb. 23, 2009 (TW) ..... 98105704 A

(51) Int. Cl.
*H01F 27/30* (2006.01)
*H01F 27/24* (2006.01)

(52) U.S. Cl. ..... 336/208; 336/198; 336/212

(58) Field of Classification Search ..... None
See application file for complete search history.

(56) References Cited

U.S. PATENT DOCUMENTS 7,199,694 B2 * 4/2007 Hao ..... 336/208
7,714,689 B1 * 5/2010 Hsieh ..... 336/208
2007/0216511 A1 * 9/2007 Tseng et al. ..... 336/208
2007/0241853 A1 * 10/2007 Yang et al. ..... 336/208
2008/0024262 A1 * 1/2008 Chang et al. ..... 336/208
2008/0169769 A1 * 7/2008 Lee ..... 315/278

FOREIGN PATENT DOCUMENTS

JP 11162746 A * 6/1999
JP 2008034599 A * 2/2008

* cited by examiner

*Primary Examiner*—Anh T Mai
(74) *Attorney, Agent, or Firm*—Kirton & McConkie; Evan R. Witt

(57) ABSTRACT

A composite transformer includes a bobbin assembly, a magnetic core covering element and a magnetic core assembly. The bobbin assembly includes at least a first connecting part and a first channel, wherein at least a primary winding coil and at least a secondary winding coil are wound around the bobbin assembly. The magnetic core covering element includes a second channel and at least a second connecting part. The at least a second connecting part of the magnetic core covering element is coupled with the at least a first connecting part of the bobbin assembly, so that the magnetic core covering element is combined with the bobbin assembly. The magnetic core assembly is partially embedded into the first channel of the bobbin assembly and the second channel of the magnetic core covering element.

18 Claims, 9 Drawing Sheets

3

COMPOSITE TRANSFORMER

FIELD OF THE INVENTION

The present invention relates to a transformer, and more particularly to a composite transformer for enhancing the electrical safety between the winding coils and the electrical safety between the coils and the magnetic core assembly.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wounded around a winding section 121 of the bobbin 12. An isolating tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wounded around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the new-generation electric products (e.g. LCD televisions), a backlight module is a crucial component for driving the light source because the LCD panel fails to illuminate by itself. Generally, the backlight module comprises a plurality of discharge lamps and a power supply system for driving these lamps. The discharge lamps are for example cold cathode fluorescent lamps (CCFLs). These discharge lamps are driven by an inverter circuit of the power supply system. As the size of the LCD panel is gradually increased, the length and the number of the lamps included in the LCD panel are increased and thus a higher driving voltage is required. As a consequence, the transformer of the inverter circuit is usually a high-voltage transformer with leakage inductance. For electrical safety, the primary winding coil and the secondary winding coil of such a transformer are separated by a partition element of the bobbin. Generally, the current generated from the power supply system will pass through a LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

Referring to FIG. 2, a schematic exploded view of a transformer used in the conventional LCD panels is illustrated. The transformer 2 of FIG. 2 principally comprises a magnetic core assembly 21, a first bobbin piece 22, a second bobbin piece 23, a primary winding coil 24 and a secondary winding coil 25. The first bobbin piece 22 has a first side plate 26. The second bobbin piece 23 has a second side plate 27 and a plurality of partition plates 23*a*. Several winding sections 23*b* are defined by any two adjacent partition plates 23*a*. According to voltage dividing principle, the number of winding sections 23*b* may be varied depending on the voltage magnitude. In addition, a first base 26*a* and a second base 27*a* are extended from the first side plate 26 and the second side plate 27, respectively. Several pins 28 and 29 are respectively arranged on the bottom surfaces of the first base 26*a* and the second base 27*a*.

For winding the primary winding coil 24 on the first bobbin piece 22, a first terminal of the primary winding coil 24 is firstly soldered on a pin 28*a* under the first base 26*a*. The primary winding coil 24 is then successively wound on the first bobbin piece 22 in the direction distant from the first side plate 26. Afterward, a second terminal of the primary winding coil 24 is returned to be soldered onto another pin 28*b* under the first base 26*a*. For winding the secondary winding coil 25 on the second bobbin piece 23, a first terminal of the secondary winding coil 25 is firstly soldered on a pin 29*a* under the second base 27*a*. The secondary winding coil 25 is then successively wound on the winding sections 23*b* of the second bobbin piece 23 in the direction distant from the second side plate 27. Afterward, a second terminal of the secondary winding coil 25 is returned to be soldered onto another pin 29*b* under the second base 27*a*. Moreover, due to the partition plate 23*a* of the second bobbin piece 23, the primary winding coil 24 is separated from the secondary winding coil 25, thereby maintaining an electrical safety distance and increasing leakage inductance of the transformer 2.

The winding structure of the transformer 2, however, still has some drawbacks. Since the transformer 2 is applied to the driver circuit of the power supply system, a higher driving voltage is required. If the voltage difference between the primary winding coil 24 and the secondary winding coil 25 is too high or the safety distance is insufficient, the transformer 2 is readily suffered from high-voltage spark. Moreover, since the magnetic core assembly 21 is partially exposed and disposed adjacent to the primary winding coil 24 and the secondary winding coil 25, the safety distance between the winding coils and the magnetic core assembly 21 is insufficient. In addition, since the primary winding coil 24 and the secondary winding coil 25 are returned back to be respectively soldered onto the pins 28*b* and 29*b* under the first base 26*a* and the second base 27*a*, portions of the primary winding coil 24 and the secondary winding coil 25 are exposed under the first bobbin piece 22 and the second bobbin piece 23. Even if the exposed portions are covered by insulating material, the safety distance is also insufficient. Under this circumstance, the transformer 2 is readily suffered from high-voltage spark or short circuit and eventually has a breakdown. For complying with the circuitry layouts of different power supply systems, the transformer manufacturers need to make a variety of bobbin molds. Under this circumstance, the fabricating cost is increased and the material management is very important.

Therefore, there is a need of providing a composite transformer so as to obviate the drawbacks encountered from the prior art.

SUMMARY OF THE INVENTION

It is an object of the present invention to provide a composite transformer for enhancing the electrical safety between the winding coils and the electrical safety between the coils and the magnetic core assembly.

Another object of the present invention provides a composite transformer for driving the circuitry of the power supply system of various discharge lamps. The composite transformer has modular components in order to reduce the fabricating cost and simplify the fabricating process.

A further object of the present invention provides a composite transformer for avoiding high-voltage spark or short circuit so as to prevent damage of the transformer.

In accordance with an aspect of the present invention, there is provided a composite transformer. The composite transformer includes a bobbin assembly, a magnetic core covering element and a magnetic core assembly. The bobbin assembly includes at least a first connecting part and a first channel, wherein at least a primary winding coil and at least a secondary winding coil are wound around the bobbin assembly. The magnetic core covering element includes a second channel and at least a second connecting part. The at least a second connecting part of the magnetic core covering element is coupled with the at least a first connecting part of the bobbin assembly, so that the magnetic core covering element is combined with the bobbin assembly. The magnetic core assembly is partially embedded into the first channel of the bobbin assembly and the second channel of the magnetic core covering element.

In accordance with another aspect of the present invention, there is provided a composite transformer. The composite transformer includes a first bobbin assembly, a second bobbin assembly, a magnetic core covering element and a magnetic core assembly. The second bobbin assembly has the same structure as the first bobbin assembly. The second bobbin assembly includes at least a first connecting part, at least a third connecting part, and a first channel. At least a primary winding coil and at least a secondary winding coil are wound around the second bobbin assembly. The magnetic core covering element includes a second channel and at least a second connecting part. The at least a first connecting part of the first bobbin assembly is selectively connected with either the at least a second connecting part of the magnetic core covering element or the at least a third connecting part of the second bobbin assembly, so that the first bobbin assembly is selectively combined with either the magnetic core covering element or the second bobbin assembly. The magnetic core assembly is partially embedded into the first channel of the first bobbin assembly and the second channel of the magnetic core covering element when the first bobbin assembly is combined with the magnetic core covering element, or partially embedded into the first channel of the first bobbin assembly and the first channel of the second bobbin assembly when the first bobbin assembly is combined with the second bobbin assembly.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
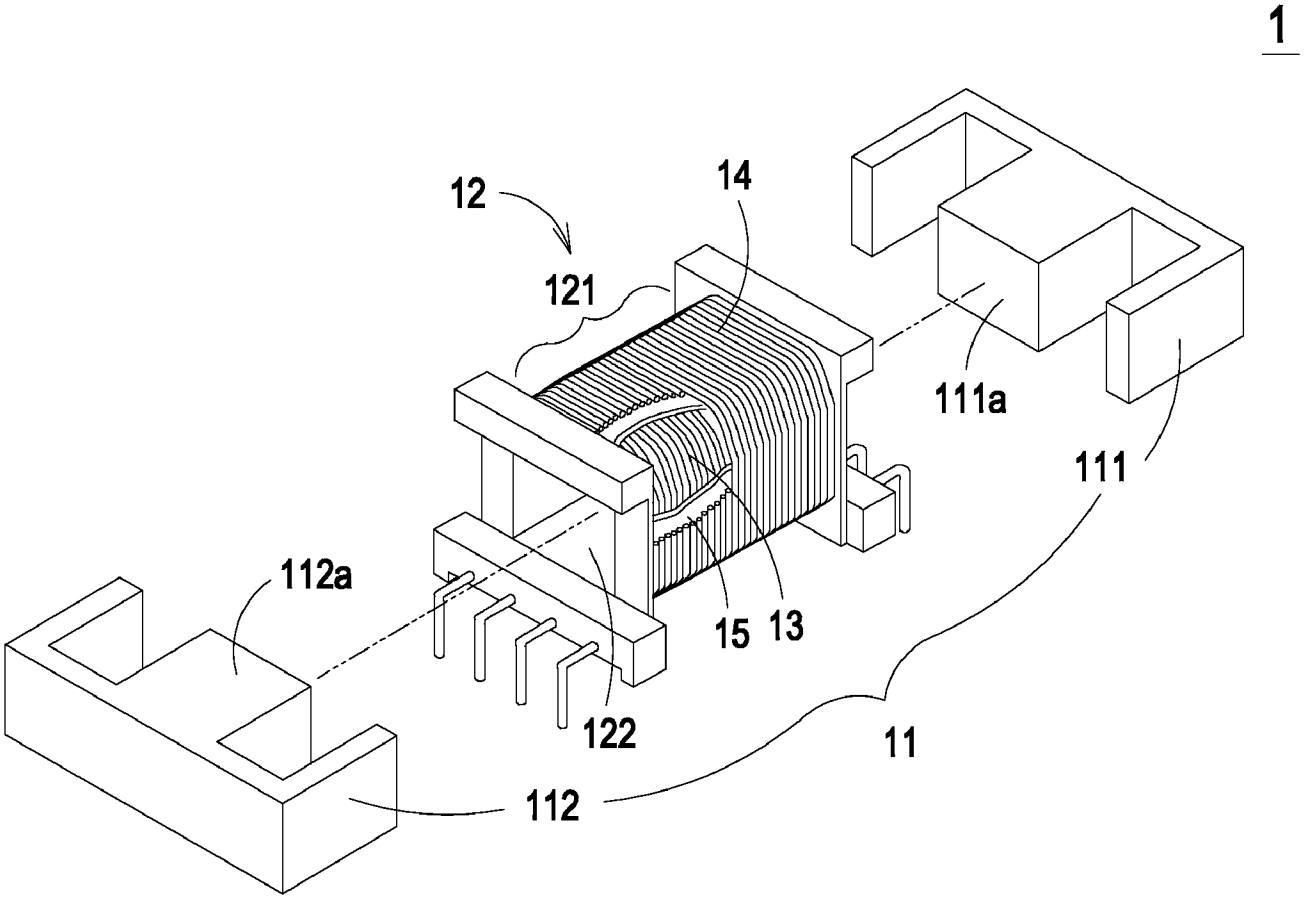
FIG. 1 PRIOR ART
FIG. 1 is a schematic exploded view of a conventional transformer.
Figure 2:
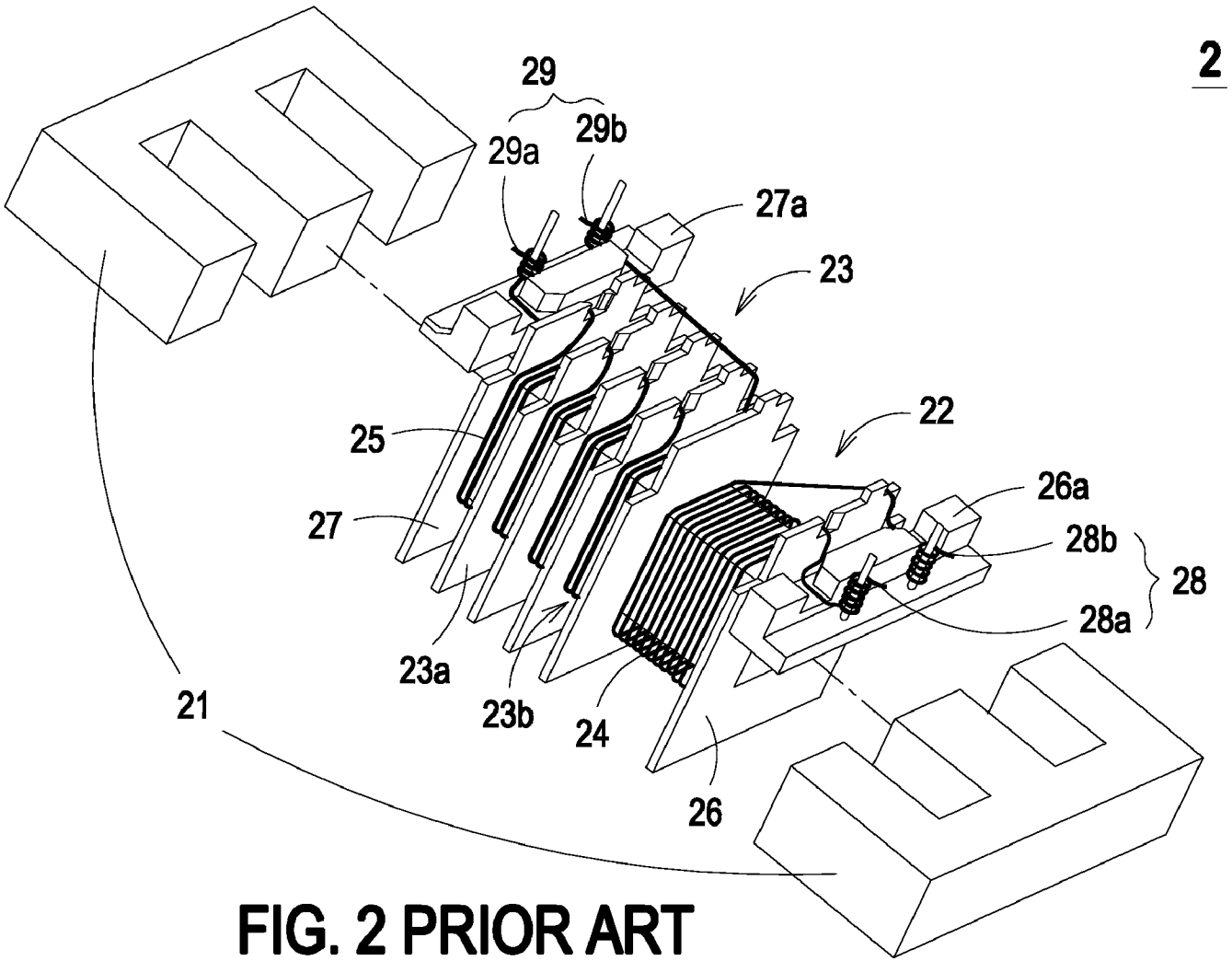
FIG. 2 PRIOR ART
FIG. 2 is a schematic exploded view illustrating a transformer used in the conventional LCD panels.
Figure 3:
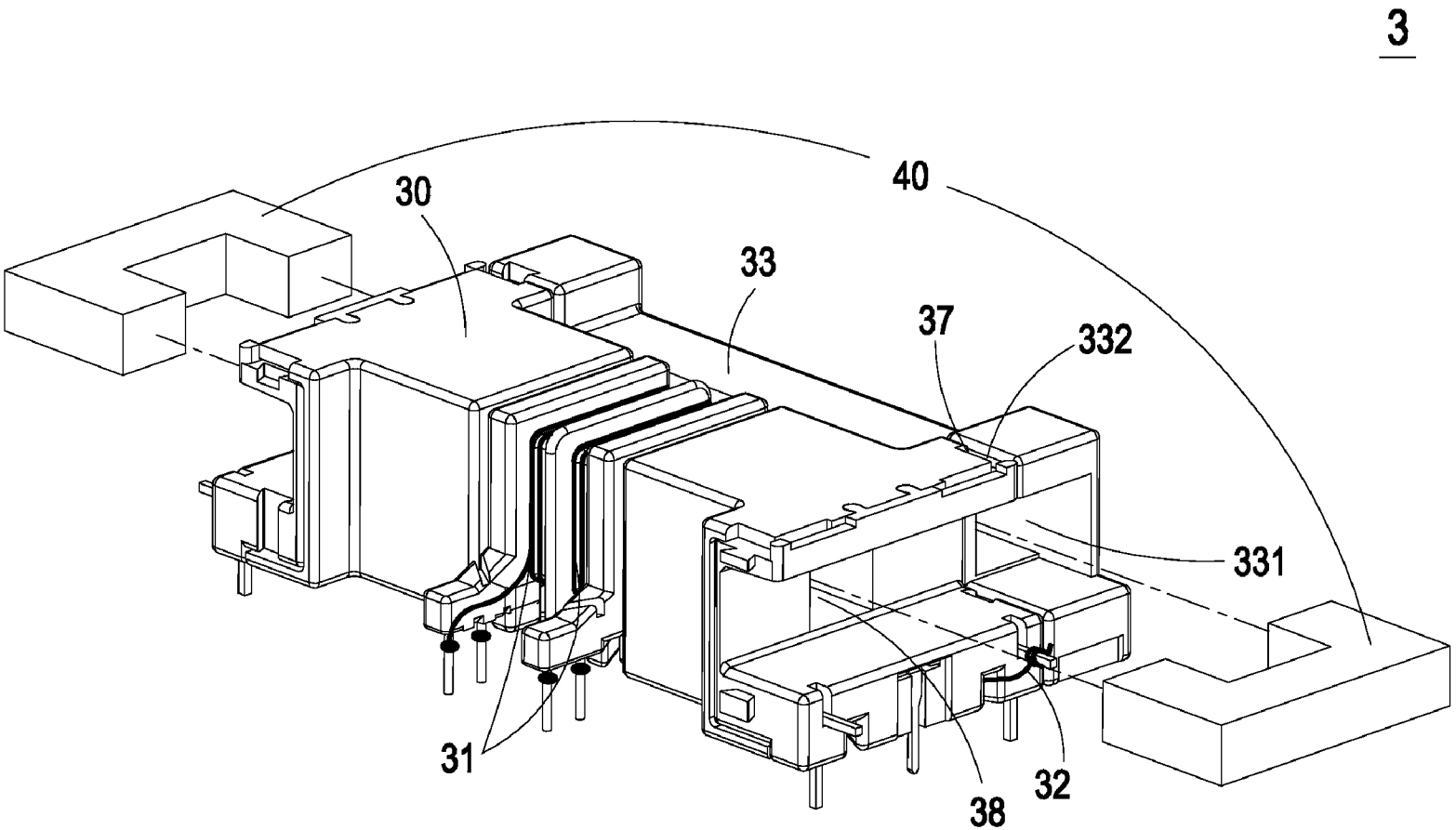
FIG. 3 is a schematic view of a composite transformer according to an embodiment of the present invention.

Referring to FIG. 3, a schematic view of a composite transformer according to an embodiment of the present invention is illustrated. The transformer 3 of FIG. 3 principally comprises a bobbin assembly 30, at least a primary winding coil 31, at least a secondary winding coil 32, a magnetic core covering element 33 and a magnetic core assembly 40. The bobbin assembly 30 includes at least a first connecting part 37 and a first channel 38. The at least a primary winding coil 31 and the at least a secondary winding coil 32 are wound around the bobbin assembly 30. The magnetic core covering element 33 includes a second channel 331 and at least a second connecting part 332. The at least a second connecting part 332 of the magnetic core covering element 33 is coupled with the at least a first connecting part 37 of the bobbin assembly 30, so that the magnetic core covering element 33 is combined with the bobbin assembly 30. The magnetic core assembly 40 is partially embedded into the first channel 38 of the bobbin assembly 30 and the second channel 331 of the magnetic core covering element 33.

Figure 4A:
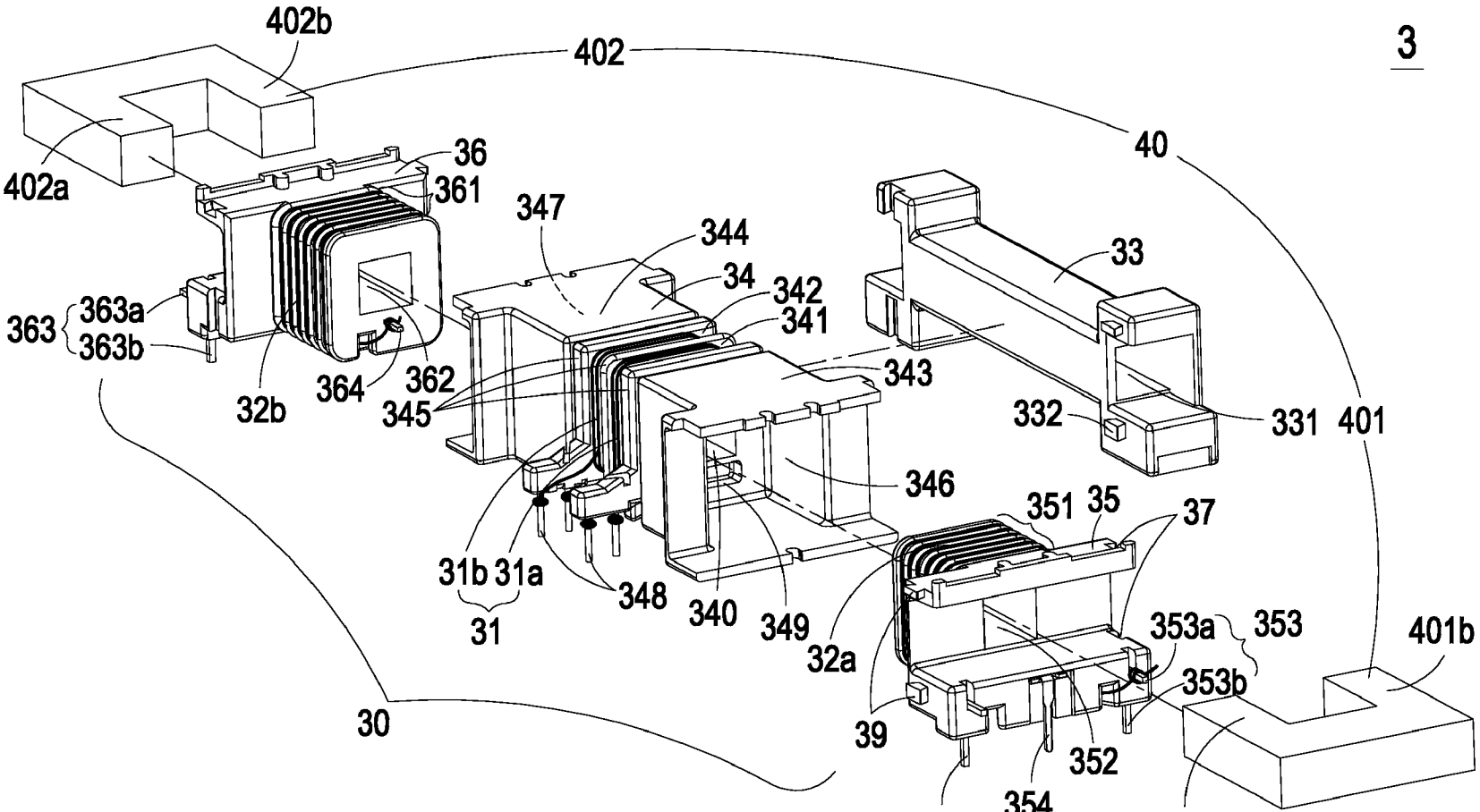
FIG. 4A is a schematic exploded view of an exemplary composite transformer shown in FIG. 3 and taken in a front-side viewpoint.
Figure 4B:
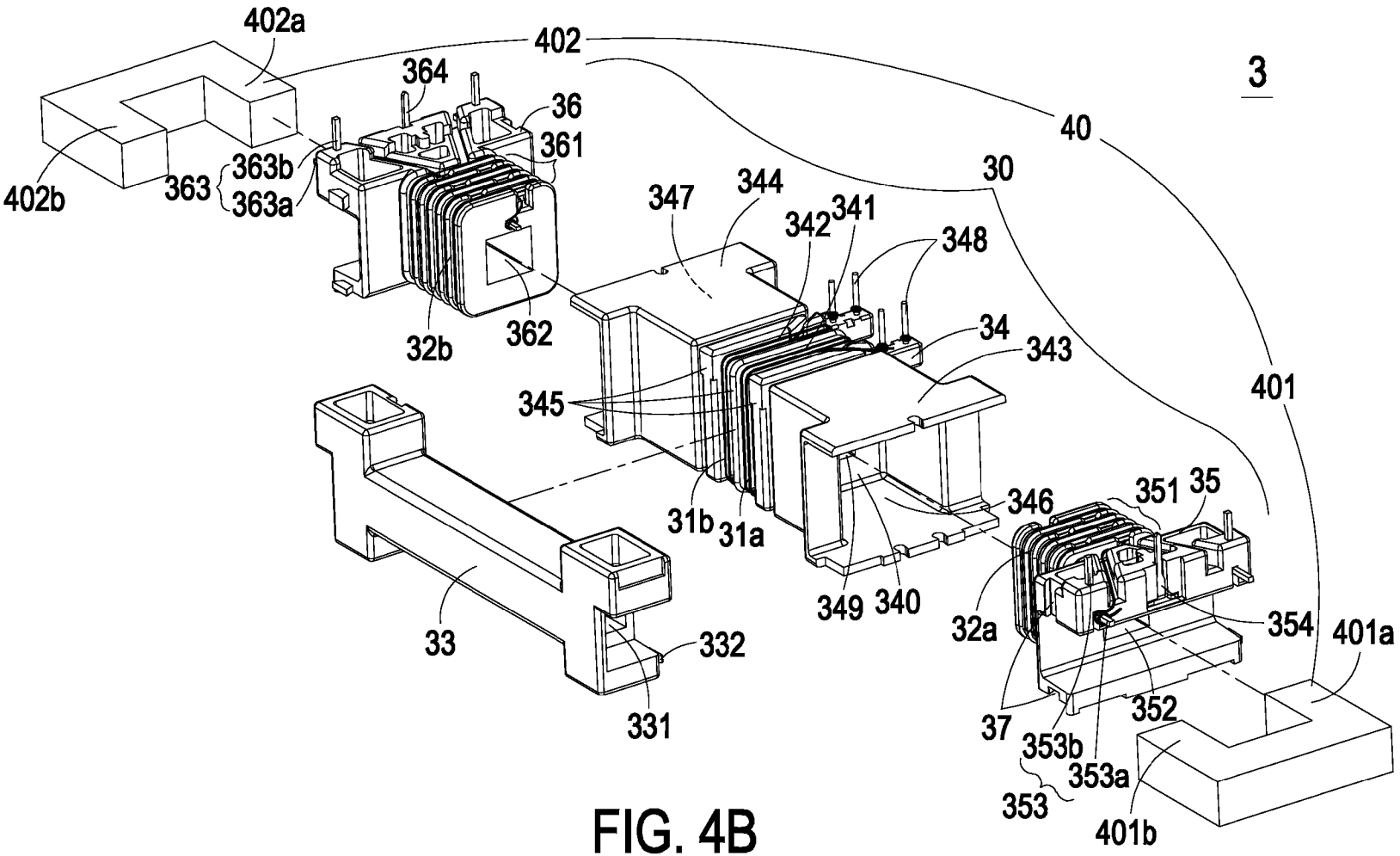
FIG. 4B is a schematic exploded view of the exemplary composite transformer shown in FIG. 3 and taken in a back-side viewpoint.

FIG. 4A is a schematic exploded view of an exemplary composite transformer shown in FIG. 3 and taken in a front-side viewpoint. FIG. 4B is a schematic exploded view of the exemplary composite transformer shown in FIG. 3 and taken in a back-side viewpoint. Please refer to FIG. 4A and FIG. 4B. The transformer 3 principally comprises a bobbin assembly 30, a first primary winding coil 31*a*, a second primary winding coil 31*b*, a first secondary winding coil 32*a*, a second secondary winding coil 32*b*, a magnetic core covering element 33 and a magnetic core assembly 40. The bobbin assembly 30 includes a primary bobbin 34, a first secondary bobbin 35 and a second secondary bobbin 36. The primary bobbin 34 includes a first primary winding section 341, a second primary winding section 342, a first sheathing part 343, a second sheathing part 344 and a first through-hole 340. The first secondary bobbin 35 includes a first secondary winding section 351 and a second through-hole 352. The second secondary bobbin 36 includes a second secondary winding section 361 and a third through-hole 362. The first primary winding coil 31*a* and the second primary winding coil 31*b* are respectively wound around the first primary winding section 341 and the second primary winding section 342 of the primary bobbin 34. The first secondary winding coil 32*a* and the second secondary winding coil 32*b* are respectively wound around the first secondary winding section 351 of the first secondary bobbin 35 and the secondary winding section 361 of the second secondary bobbin 36. The first secondary bobbin 35 is partially received in the first sheathing part 343 of the primary bobbin 34. The second secondary bobbin 36 is partially received in the second sheathing part 344 of the primary bobbin 34. The first through-hole 340 of the primary bobbin 34, the second through-hole 352 of the first secondary bobbin 35 and the third through-hole 362 of the second secondary bobbin 36 collectively define a first channel 38 of the bobbin assembly 30. The magnetic core covering element 33 is combined with the bobbin assembly 30, and includes a second channel 331. The bobbin assembly 30 includes a first connecting part 37. The magnetic core covering element 33 includes a second connecting part 332. The first connecting part 37 of the bobbin assembly 30 and the second connecting part 332 of the magnetic core covering element 33 are coupled with or engaged with each other. As such, the magnetic core covering element 33 and the bobbin assembly 30 are detachably connected with each other.

Please refer to FIG. 3, FIG. 4A and FIG. 4B again. The magnetic core assembly 40 includes a first magnetic part 401 and a second magnetic part 402. The first magnetic part 401 includes a first lateral leg 401*a* and a second lateral leg 401*b*. The second magnetic part 402 includes a first lateral leg 402*a* and a second lateral leg 402*b*. The first lateral leg 401*a* of the first magnetic part 401 is embedded into the first channel 38 through the second through-hole 352 of the first secondary bobbin 35. The first lateral leg 402*a* of the second magnetic part 402 is embedded into the first channel 38 through the third through-hole 362 of the second secondary bobbin 36. The second lateral leg 401*b* of the first magnetic part 401 and the second lateral leg 402*b* of the second magnetic part 402 are embedded into the second channel 331. As such, the primary winding coils 31*a*, 31*b* and the secondary winding coils 32*a*, 32*b* interact with the magnetic core assembly 40 to achieve the purpose of voltage regulation. Moreover, the use of the magnetic core covering element 33 can increase the safety distance between the primary winding coils 31*a*, 31*b* and the magnetic core assembly 40 and the safety distance between the secondary winding coils 32*a*, 32*b* and the magnetic core assembly 40.

In this embodiment, the first primary winding section 341, the second primary winding section 342, the first sheathing part 343 and the second sheathing part 344 of the primary bobbin 34 are separated from each other by one or more partition plates 345. The first sheathing part 343 and the second sheathing part 344 are arranged at opposite sides of the primary bobbin 34. The first primary winding section 341 and the second primary winding section 342 are arranged between the first sheathing part 343 and the second sheathing part 344. It is preferred that the primary bobbin 34 is made of insulating material and integrally formed into a one-piece structure. In addition, the magnetic core covering element 33 is made of insulating material and integrally formed into a one-piece structure.

In this embodiment, the first sheathing part 343 has a first receptacle 346 for receiving the first secondary winding section 351 of the first secondary bobbin 35 and the first secondary winding coil 32*a* wound around the first secondary winding section 351. By the first sheathing part 343, the primary winding coils 31*a*, 31*b* are isolated from the first secondary winding coil 32*a* so as to provide a desired safety distance between the primary winding coils 31*a*, 31*b* and the first secondary winding coil 32*a*. The second sheathing part 344 has a second receptacle 347 for receiving the second secondary winding section 361 of the second secondary bobbin 36 and the second secondary winding coil 32*b* wound around the second secondary winding section 361. By the second sheathing part 344, the primary winding coils 31*a*, 31*b* are isolated from the second secondary winding coil 32*b* so as to provide a desired safety distance between the primary winding coils 31*a*, 31*b* and the second secondary winding coil 32*b*. In addition, the first through-hole 340 is communicated with the first receptacle 346 and the second receptacle 347.

In this embodiment, the primary bobbin 34 further includes several pins 348. The pins 348 are connected to the terminals of the first primary winding coil 3la or the second primary winding coil 3lb. In addition, the pins 348 are inserted into corresponding holes of a circuit board (not shown). The pins 348 are arranged on the extension part of the partition plate 345. In this embodiment, the first secondary bobbin 35 has at least a first pin 353 and a second pin 354. The second secondary bobbin 36 has at least a first pin 363 and a second pin 364. The first pin 353 of the first secondary bobbin 35 has a first coupling part 353*a* and a second coupling part 353*b*, which are perpendicular to each other. The first pin 363 of the second secondary bobbin 36 has a first coupling part 363*a* and a second coupling part 363*b*, which are perpendicular to each other. The first coupling parts 353*a*, 363*a* of the first pin 353, 363 are respectively connected to a terminal of the first secondary winding coil 32*a* and a terminal of the second secondary winding coil 32*b*. The second coupling part 353*b*, 363*b* of the first pin 353, 363 are inserted into corresponding holes of the circuit board. The first coupling parts 353*a*, 363*a* and the second coupling part 353*b*, 363*b* are made of conductive material such as copper or aluminum. The first coupling parts 353*a* and the second coupling part 353*b* of the first pin 353 are integrally formed such that the first pin 353 is L-shaped. Similarly, the first coupling part 363*a* and the second coupling part 363*b* of the first pin 363 are integrally formed such that the first pin 363 is L-shaped. Since the first secondary winding coil 32*a* and the second secondary winding coil 32*b* are connected to the first coupling parts 353*a*, 363*a* of the first pin 353, 363, the first secondary winding coil 32*a* and the second secondary winding coil 32*b* are electrically connected with the circuit board through the second coupling part 353*b*, 363*b*. The L-shaped first pins 363 have stronger structural strength and reduced height. Moreover, since the outlet terminals of the secondary coils are connected to the first coupling parts, the outlet terminals are no longer arranged between the pins and the circuit board and the pin's evenness is enhanced.

Figure 5:
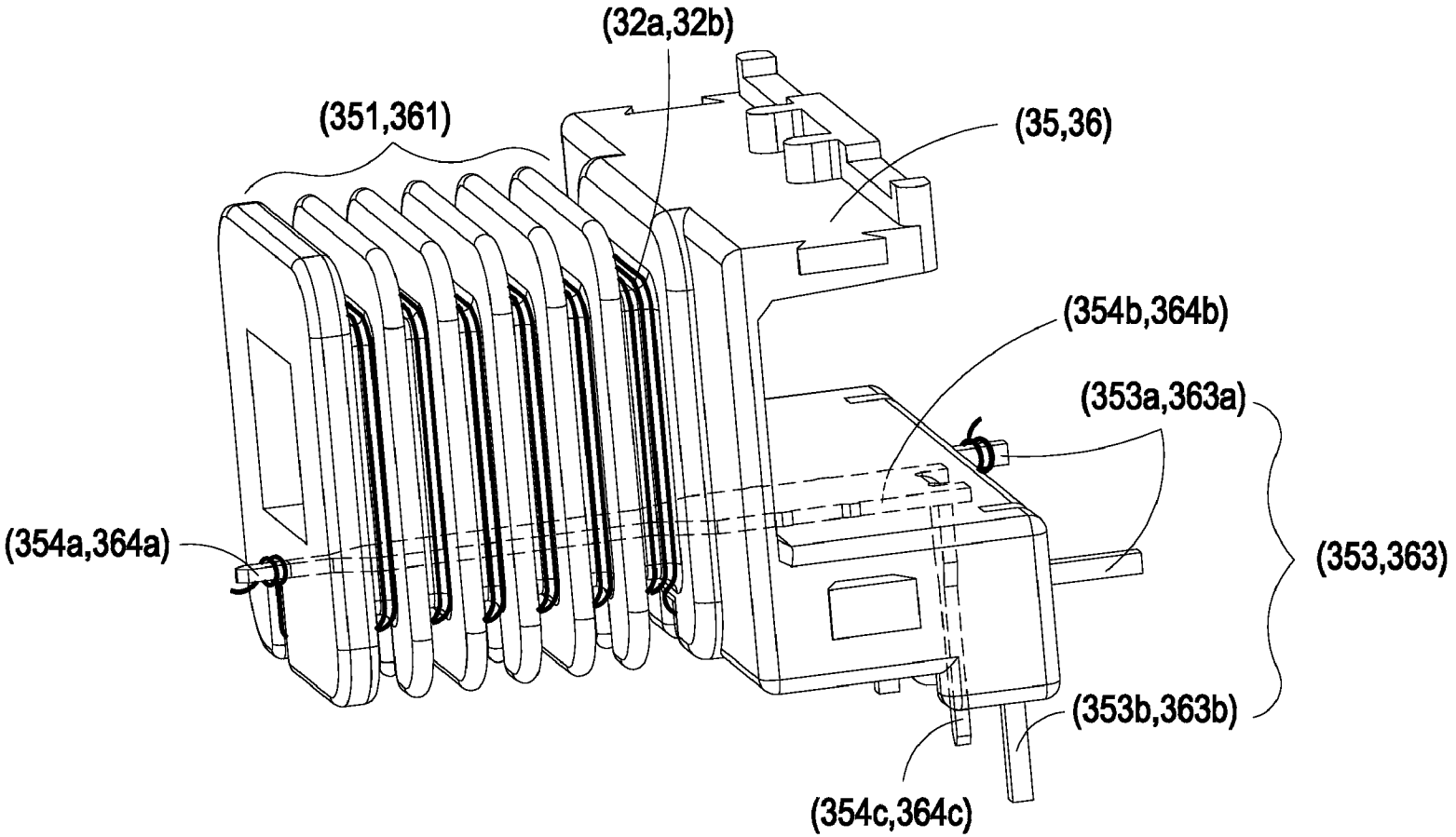
FIG. 5 is a schematic perspective view illustrating the first secondary bobbin or the second secondary bobbin of the composite transformer shown in FIGS. 4A and 4B.

FIG. 5 is a schematic perspective view illustrating the first secondary bobbin or the second secondary bobbin of the composite transformer shown in FIGS. 4A and 4B. The second pin 354 of the first secondary bobbin 35 includes a wire-arranging part 354*a*, an intermediate part 354*b* and an insertion part 354*c*. The intermediate part 354*b* is buried in the internal portion of the first secondary bobbin 35 and interconnected between the wire-arranging part 354*a* and the insertion part 354*c*. The wire-arranging part 354*a* is protruded from a side plate of the first secondary bobbin 35. The insertion part 354*c* is protruded from the bottom surface of the first secondary bobbin 35 to be inserted into a corresponding hole of the circuit board. Similarly, the second pin 364 of the second secondary bobbin 36 includes a wire-arranging part 364*a*, an intermediate part 364*b* and an insertion part 364*c*. The intermediate part 364*b* is buried in the internal portion of the second secondary bobbin 36 and interconnected between the wire-arranging part 364*a* and the insertion part 364*c*. The wire-arranging part 364*a* is protruded from a side plate of the second secondary bobbin 36. The insertion part 364*c* is protruded from the bottom surface of the second secondary bobbin 36 to be inserted into a corresponding hole of the circuit board. In accordance with the present invention, the second pins 354, 364 are respectively formed in the first secondary bobbin 35 and the second secondary bobbin 36 by a punching technology, an embedding technology or a metal insert molding technology that is known in the art.

Hereinafter, a process of winding the first secondary winding coil 32*a* around the first secondary bobbin 35 will be illustrated as follows with reference to FIG. 5. First of all, a first terminal of the first secondary winding coil 32*a* is soldered on the first coupling parts 353*a* of the first pin 353 of the first secondary bobbin 35. Then, the first secondary winding coil 32*a* is wound around the first secondary winding section 351 of the first secondary bobbin 35. After a second terminal of the first secondary winding coil 32*a* is soldered on the wire-arranging part 354*a* of the second pin 354, process of winding the first secondary winding coil 32*a* around the first secondary bobbin 35 is completed. As a consequence, the electricity generated from the first secondary winding coil 32*a* is transmitted from the wire-arranging part 354*a* to the circuit board through the intermediate part 354*b* and the insertion part 354*c*. Since the second terminal of the first secondary winding coil 32*a* is soldered on the wire-arranging part 354*a* of the second pin 354 without the need of returning to the first pin side, the problem of causing high-voltage spark or short circuit is avoided. The process of winding the second secondary winding coil 32*b* around the second secondary bobbin 36 is similar to that of winding the first secondary winding coil 32*a* around the first secondary bobbin 35, and is not redundantly described herein. In some embodiment, a first indentation 349 and a second indentation (not shown) are respectively formed in the inner surfaces of the first receptacle 346 and the second receptacle 347 of the primary bobbin 34 for accommodating the wire-arranging parts 354*a*, 364 of the second pins 354, 364.

Please refer to FIGS. 4A and 4B again. The first connecting part 37 of the bobbin assembly 30 is arranged at a first side of the first secondary bobbin 35 and/or the second secondary bobbin 36. In some embodiments, the bobbin assembly 30 further includes a third connecting part 39. The third connecting part 39 is arranged at a second side of the first secondary bobbin 35 and/or the second secondary bobbin 36, wherein the second side is opposed to the first side. In this embodiment, the second connecting part 332 of the magnetic core covering element 33 is arranged at a side facing the first connecting part 37 of the first secondary bobbin 35.

In this embodiment, the first connecting part 37 is a recess or a concave track, the second connecting part 332 is a bulge or a convex track, and the third connecting part 39 is a bulge or a convex track. In addition, the second connecting part 332 and the third connecting part 39 have the same structure. By means of the first connecting part 37 and the second connecting part 332, the magnetic core covering element 33 and the bobbin assembly 30 are detachably connected with or engaged with each other. Moreover, when the third connecting part 39 is engaged with the first connecting part of an additional bobbin assembly 30, the number of the bobbin assemblies 30 can be increased as required.

Figure 6A:
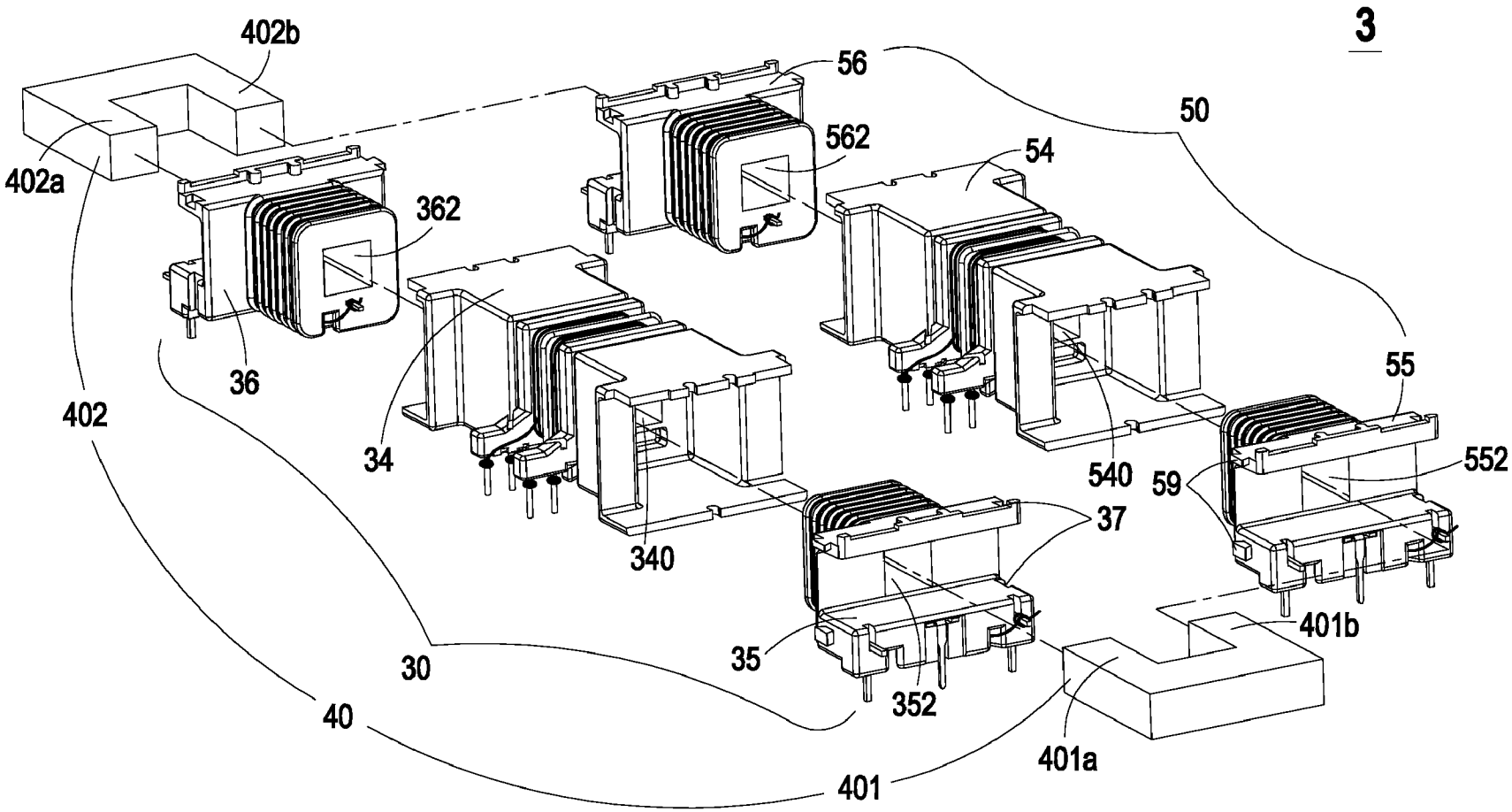
FIG. 6A is a schematic exploded view of a composite transformer according to another embodiment of the present invention.
Figure 6B:
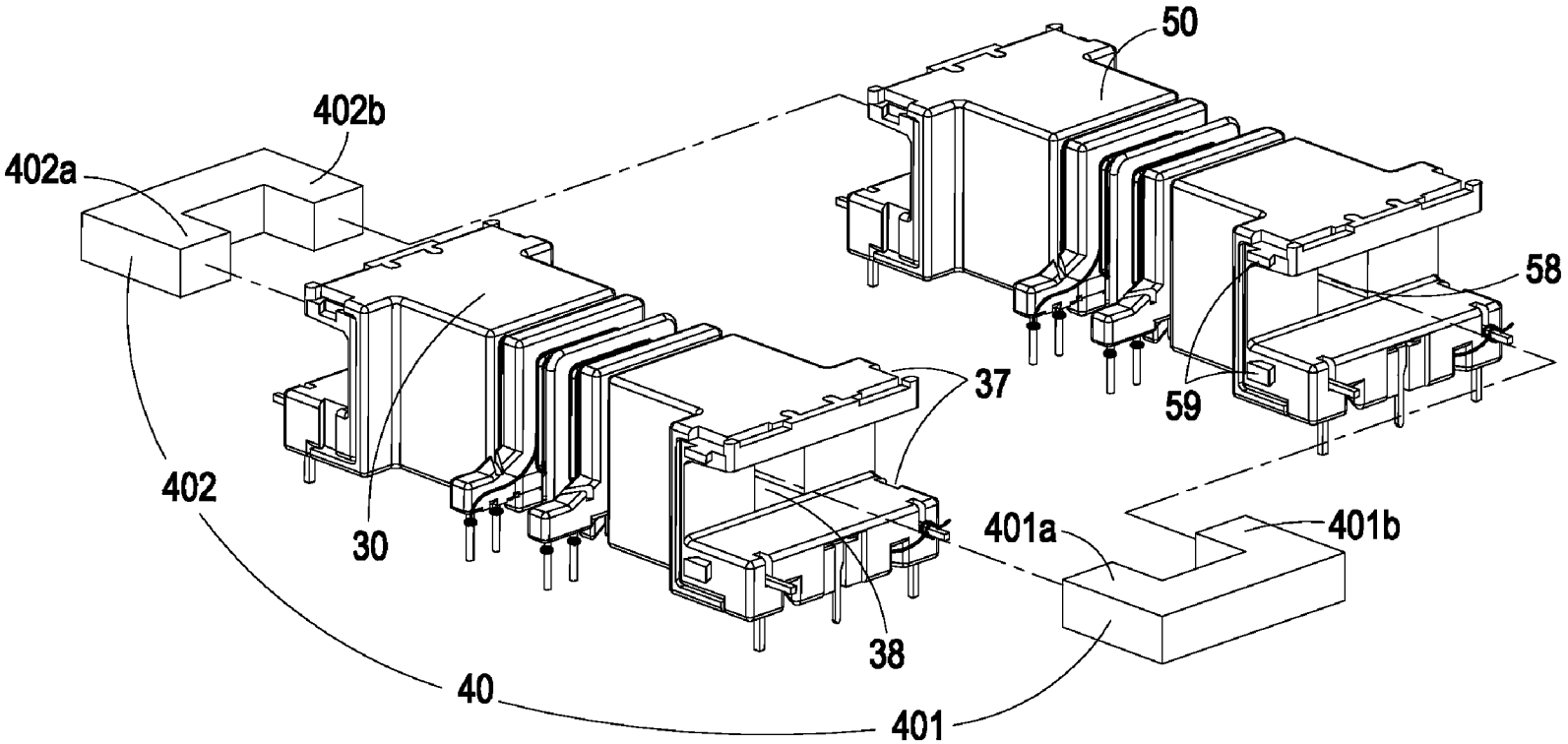
FIG. 6B is a schematic assembled view of the composite transformer shown in FIG. 6A.

For driving the circuitry of the power supply system of various discharge lamps and saving the layout area of the circuit board, two or more bobbin assemblies of the same structure can be combined together to form the composite transformer. FIG. 6A is a schematic exploded view of a composite transformer according to another embodiment of the present invention. FIG. 6B is a schematic assembled view of the composite transformer shown in FIG. 6A. Please refer to FIG. 6A and FIG. 6B. The transformer 3 principally comprises a first bobbin assembly 30, a second bobbin assembly 50 and a magnetic core assembly 40. The second bobbin assembly 50 and the first bobbin assembly 30 have the same structure and function. Component parts and elements corresponding to those of the first embodiment are designated by like numeral references, and detailed description thereof is omitted. In this embodiment, the first bobbin assembly 30 includes a primary bobbin 34, a first secondary bobbin 35 and a second secondary bobbin 36. The first through-hole 340 of the primary bobbin 34, the second through-hole 352 of the first secondary bobbin 35 and the third through-hole 362 of the second secondary bobbin 36 collectively define the first channel 38 of the first bobbin assembly 30. The second bobbin assembly 50 includes a primary bobbin 54, a first secondary bobbin 55 and a second secondary bobbin 56. The first through-hole 540 of the primary bobbin 54, the second through-hole 552 of the first secondary bobbin 55 and the third through-hole 562 of the second secondary bobbin 56 collectively define the first channel 58 of the second bobbin assembly 50. The first bobbin assembly 30 and the second bobbin assembly 50 are arranged side by side. When the first connecting part 37 of the first bobbin assembly 30 is connected with or engaged with the third connecting part of the second bobbin assembly 50, the first bobbin assembly 30 and the second bobbin assembly 50 are combined together. The first lateral leg 401*a* of the first magnetic part 401 is embedded into the first channel 38 through the second through-hole 352 of the first secondary bobbin 35. The second lateral leg 401*b* of the first magnetic part 401 is embedded into the first channel 58 through the second through-hole 552 of the first secondary bobbin 55. The first lateral leg 402*a* of the second magnetic part 402 is embedded into the first channel 38 through the third through-hole 362 of the second secondary bobbin 36. The second lateral leg 402*b* of the second magnetic part 402 is embedded into the first channel 58 through the third through-hole 562 of the second secondary bobbin 56. As such, the primary winding coils and the secondary winding coils interact with the magnetic core assembly 40 to achieve the purpose of voltage regulation.

Figure 7:
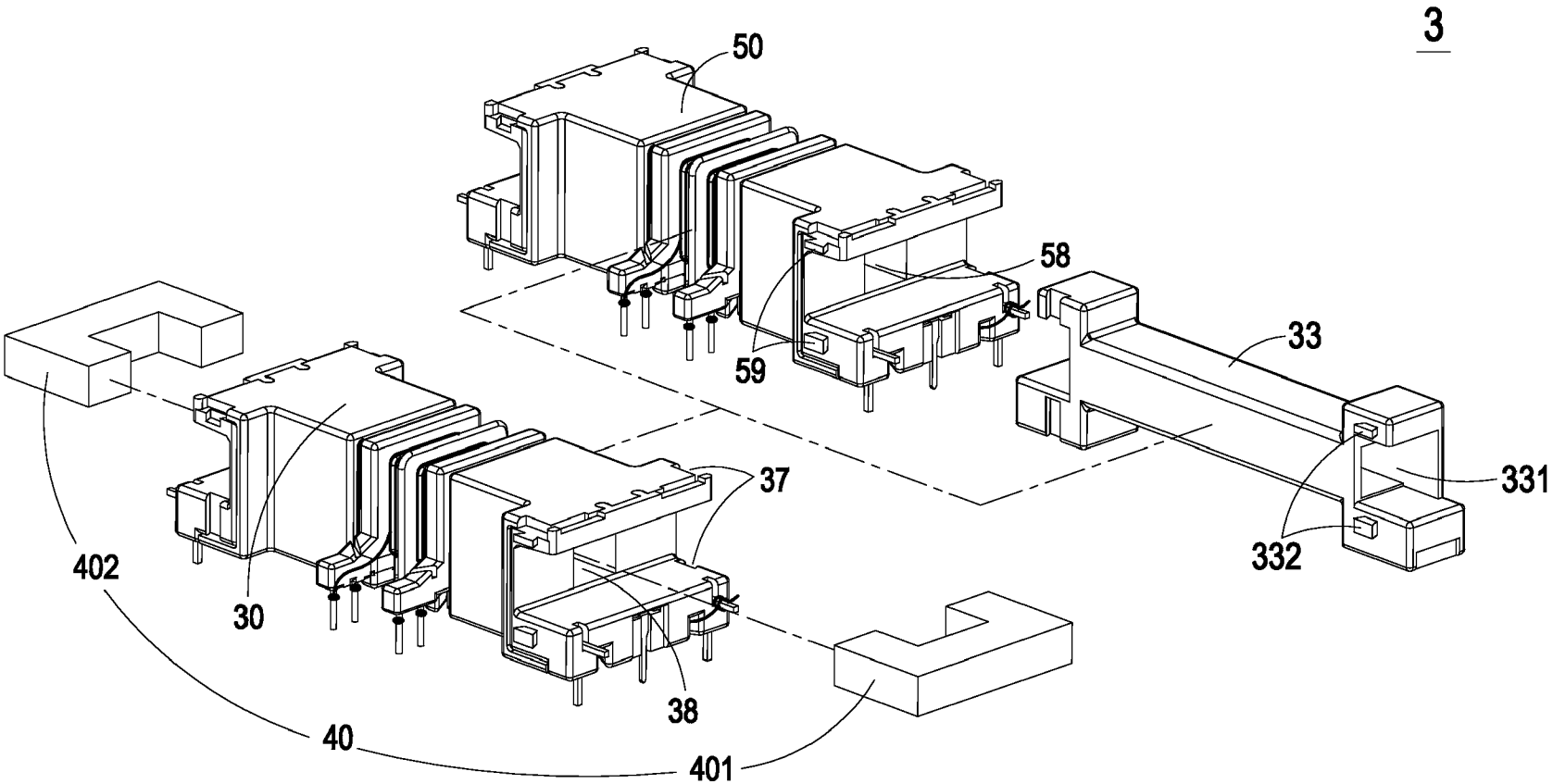
FIG. 7 is a schematic view illustrating the flexibility of assembling the composite transformer of the present invention.

FIG. 7 is a schematic view illustrating the flexibility of assembling the composite transformer of the present invention. As shown in FIG. 7, the transformer 3 principally comprises a first bobbin assembly 30, a second bobbin assembly 50, a magnetic core covering element 33 and a magnetic core assembly 40. The second bobbin assembly 50 and the first bobbin assembly 30 have the same structure and function. The configurations of the first bobbin assembly 30, the second bobbin assembly 50, the magnetic core covering element 33 and the magnetic core assembly 40 are identical to those shown in FIGS. 4A, 4B, 6A and 6B, and are not redundantly described herein. The first connecting part 37 of the first bobbin assembly 30 is engaged with either the second connecting part 332 of the magnetic core covering element 33 or the third connecting part 59 of the second bobbin assembly 50, so that the first bobbin assembly 30 is combined with either the magnetic core covering element 33 or the second bobbin assembly 50. In a case that the first bobbin assembly 30 is combined with the magnetic core covering element 33, the magnetic core assembly 40 is partially embedded into the first channel 38 of the first bobbin assembly 30 and the second channel 331 of the magnetic core covering element 33. Whereas, in a case that the first bobbin assembly 30 is combined with the second bobbin assembly 50, the magnetic core assembly 40 is partially embedded into the first channel 38 of the first bobbin assembly 30 and the first channel 58 of the second bobbin assembly 50. In this embodiment, the second connecting part 332 of the magnetic core covering element 33 and the third connecting part 59 of the second bobbin assembly 50 have the same structure. For driving the circuitry of the power supply system of various discharge lamps and saving the layout area of the circuit board, the transformer manufacturers may selectively combine two bobbin assemblies together or combine a bobbin assembly with a magnetic core covering element according to the practical requirements.

From the above embodiment, the composite transformer of the present invention is effective for enhancing the electrical safety between the winding coils and the electrical safety between the coils and the magnetic core assembly. In addition, the composite transformer of the present invention can be used for driving the circuitry of the power supply system of various discharge lamps. The composite transformer has modular components in order to reduce the fabricating cost and simplify the fabricating process. Moreover, the composite transformer of the present invention is capable of avoiding high-voltage spark or short circuit so as to prevent damage of the transformer.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A composite transformer comprising:

a bobbin assembly comprising at least a first connecting part and a first channel, wherein at least a primary winding coil and at least a secondary winding coil are wound around said bobbin assembly;

a magnetic core covering element comprising a second channel and at least a second connecting part, wherein said at least a second connecting part of said magnetic core covering element is coupled with said at least a first connecting part of said bobbin assembly, so that said magnetic core covering element is combined with said bobbin assembly; and a magnetic core assembly comprising a plurality of magnetic parts, each of which includes a first lateral leg and a second lateral leg, wherein said first lateral leg and said second lateral leg are partially embedded into said first channel of said bobbin assembly and said second channel of said magnetic core covering element, respectively.

2. The composite transformer according to claim 1 wherein said bobbin assembly comprises:

a primary bobbin comprising a first primary winding section, a second primary winding section, a first sheathing part, a second sheathing part and a first through-hole;

a first secondary bobbin comprising a first secondary winding section and a second through-hole;

a second secondary bobbin comprising a second secondary winding section and a third through-hole, wherein said first through-hole of said primary bobbin, said second through-hole of said first secondary bobbin and said third through-hole of said second secondary bobbin collectively define said first channel of said bobbin assembly.

3. The composite transformer according to claim 2 wherein said at least a primary winding coil includes a first primary winding coil and a second primary winding coil, which are respectively wound around said first primary winding section and said second primary winding section of said primary bobbin, and said at least a secondary winding coil includes a first secondary winding coil and a second secondary winding coil, which are respectively wound around said first secondary winding section of said first secondary bobbin and said secondary winding section of said second secondary bobbin.

4. The composite transformer according to claim 3 wherein said first sheathing part has a first receptacle for receiving said first secondary winding section and said first secondary winding coil wound around said first secondary winding section, and said second sheathing part has a second receptacle for receiving the second secondary winding section and said second secondary winding coil wound around said second secondary winding section.

5. The composite transformer according to claim 4 wherein said first through-hole is communicated with said first receptacle and said second receptacle.

6. The composite transformer according to claim 3 wherein said first primary winding section, said second primary winding section, said first sheathing part and said second sheathing part of said primary bobbin are separated from each other by at least a partition plate.

7. The composite transformer according to claim 3 wherein said first sheathing part and said second sheathing part are arranged at opposite sides of said primary bobbin, and said first primary winding section and said second primary winding section are arranged between said first sheathing part and said second sheathing part.

8. The composite transformer according to claim 3 wherein said primary bobbin further includes multiple pins, which are connected to terminals of said first primary winding coil or said second primary winding coil and inserted into a circuit board.

9. The composite transformer according to claim 3 wherein each of said first secondary bobbin and said second secondary bobbin has at least a first pin and a second pin.

10. The composite transformer according to claim 9 wherein said first pin of said first secondary bobbin or second secondary bobbin has a first coupling part and a second coupling part, which are perpendicular to each other.

11. The composite transformer according to claim 9 wherein said second pin of said first secondary bobbin or second secondary bobbin includes a wire-arranging part, an intermediate part and an insertion part, wherein said intermediate part is buried in the internal portion of said first secondary bobbin or said second secondary bobbin, and interconnected between said wire-arranging part and said insertion part.

12. The composite transformer according to claim 11 wherein a first indentation and a second indentation are respectively formed in inner surfaces of said first receptacle and said second receptacle of said primary bobbin for accommodating said wire-arranging parts of said second pins.

13. The composite transformer according to claim 3 wherein said first connecting part of said bobbin assembly is arranged at a first side of said first secondary bobbin and/or said second secondary bobbin, and said second connecting part of said magnetic core covering element is arranged at a side facing said first connecting part.

14. The composite transformer according to claim 13 wherein said bobbin assembly further includes a third connecting part, which is arranged at a second side of said first secondary bobbin and/or said second secondary bobbin, wherein said second side is opposed to said first side.

15. The composite transformer according to claim 14 wherein said first connecting part is a recess or a concave track, said second connecting part is a bulge or a convex track, said third connecting part is a bulge or a convex track, and said second connecting part and said third connecting part have the same structure.

16. The composite transformer according to claim 3 further comprising an additional bobbin assembly having the same structure as said bobbin assembly.

17. A composite transformer comprising:

a first bobbin assembly;

a second bobbin assembly having the same structure as said first bobbin assembly, and comprising at least a first connecting part, at least a third connecting part, and a first channel, wherein at least a primary winding coil and at least a secondary winding coil are wound around said second bobbin assembly;

a magnetic core covering element comprising a second channel and at least a second connecting part, wherein said at least a first connecting part of said first bobbin assembly is selectively connected with either said at least a second connecting part of said magnetic core covering element or said at least a third connecting part of said second bobbin assembly, so that said first bobbin assembly is selectively combined with either said magnetic core covering element or said second bobbin assembly; and a magnetic core assembly comprising a plurality of magnetic parts, each of which includes a first lateral leg and a second lateral leg, wherein said first lateral leg and said second lateral leg are partially embedded into said first channel of said first bobbin assembly and said second channel of said magnetic core covering element, respectively, when said first bobbin assembly is combined with said magnetic core covering element, or partially embedded into said first channel of said first bobbin assembly and said first channel of said second bobbin assembly when said first bobbin assembly is combined with said second bobbin assembly.

18. The composite transformer according to claim 17 wherein said second connecting part and said third connecting part have the same structure.

* * * * *